US009217284B2

(12) United States Patent
Panseri et al.

(10) Patent No.: US 9,217,284 B2
(45) Date of Patent: Dec. 22, 2015

(54) ANTI-DROP TRANSMISSION DEVICE FOR A SERVICE DOOR WITH A FLEXIBLE CURTAIN

(75) Inventors: Anne-Sophie Panseri, Montanay (FR); Romain Simon, Caluire (FR)

(73) Assignee: SOFINECO, Decines (FR)

( * ) Notice: Subject to any disclaimer, the term of this patent is extended or adjusted under 35 U.S.C. 154(b) by 970 days.

(21) Appl. No.: 13/387,430

(22) PCT Filed: Jul. 29, 2010

(86) PCT No.: PCT/FR2010/000554

§ 371 (c)(1),
(2), (4) Date: Mar. 6, 2012

(87) PCT Pub. No.: WO2011/015725

PCT Pub. Date: Feb. 10, 2011

(65) Prior Publication Data

US 2012/0145335 A1 Jun. 14, 2012

(30) Foreign Application Priority Data

Jul. 30, 2009 (FR) ..... 09 03747

(51) Int. Cl.

| | |
|---|---|
| ***E05F 15/00*** | (2015.01) |
| ***E06B 9/84*** | (2006.01) |
| ***E05D 13/00*** | (2006.01) |
| ***E06B 9/70*** | (2006.01) |

(52) U.S. Cl.

CPC ..... *E06B 9/84* (2013.01); *E05D 13/003* (2013.01); *E06B 9/70* (2013.01); *E05Y 2900/00* (2013.01); *E05Y 2900/106* (2013.01)

(58) Field of Classification Search

CPC ..... E06B 9/84; E06B 9/82; E06B 9/70; E06B 9/88; E06B 9/80; E05D 13/003; E05D 13/10

USPC ..... 160/8, 9, 188, 189, 190, 219, 293.1, 160/296, 310

See application file for complete search history.

(56) References Cited

U.S. PATENT DOCUMENTS

| | | | | |
|---|---|---|---|---|
| 3,637,004 | A * | 1/1972 | Wardlaw et al. | 160/133 |
| 3,853,167 | A * | 12/1974 | Wardlaw | 160/133 |
| 4,704,914 | A | 11/1987 | Horng | |
| 4,976,302 | A * | 12/1990 | Taylor | 160/310 |
| 4,997,022 | A * | 3/1991 | Klein | 160/265 |

(Continued)

FOREIGN PATENT DOCUMENTS

| | | |
|---|---|---|
| EP | 1 739 274 | 1/2007 |
| GB | 2 188 673 | 10/1987 |

OTHER PUBLICATIONS

International Search Report dated Feb. 2, 2011, corresponding to PCT/FR2010/000554.

*Primary Examiner* — Katherine Mitchell
*Assistant Examiner* — Johnnie A Shablack
(74) *Attorney, Agent, or Firm* — Young & Thompson

(57) ABSTRACT

An anti-fall transmission device for a handling door (1) having a flexible curtain (5) to be stacked or rolled about a drive shaft (4) during the movements thereof between an open and a closed position, includes a separate electric motor or gear motor (7) attached along a rotational axis which is offset and parallel to that of the drive shaft (4), as a protective anti-fall device (8) for connecting the motor or the gear motor (7) to the drive shaft (4) and for preventing the flexible apron (5) from accidentally falling.

20 Claims, 7 Drawing Sheets

(56) References Cited

U.S. PATENT DOCUMENTS

| | | | | |
|---|---|---|---|---|
| 5,203,392 | A | 4/1993 | Shea | |
| 5,494,093 | A * | 2/1996 | Eiterman | 160/300 |
| 5,706,552 | A | 1/1998 | Hsieh | |
| 5,960,849 | A * | 10/1999 | Delaney et al. | 160/188 |
| 6,019,156 | A | 2/2000 | Wagner et al. | |
| 6,070,641 | A * | 6/2000 | Budetti | 160/302 |
| 6,123,134 | A * | 9/2000 | Thomas et al. | 160/8 |
| 6,155,324 | A * | 12/2000 | Elliott et al. | 160/1 |
| 6,422,965 | B1 * | 7/2002 | Balli et al. | 475/149 |
| 6,484,784 | B1 * | 11/2002 | Weik et al. | 160/7 |
| 6,485,068 | B1 * | 11/2002 | Sauve | 292/171 |
| 6,782,662 | B2 * | 8/2004 | McCartney et al. | 49/197 |
| 6,900,602 | B1 * | 5/2005 | Hsieh | 318/9 |
| 8,037,922 | B2 * | 10/2011 | Hawkins et al. | 160/310 |
| 8,069,896 | B2 * | 12/2011 | Magro | 160/1 |
| 8,397,787 | B1 * | 3/2013 | Daus et al. | 160/9 |
| 8,651,164 | B2 * | 2/2014 | Klish et al. | 160/7 |
| 2001/0009212 | A1 * | 7/2001 | Ohba et al. | 188/1.11 W |
| 2002/0184824 | A1 * | 12/2002 | McCartney et al. | 49/322 |
| 2005/0045283 | A1 * | 3/2005 | Hsieh | 160/189 |
| 2005/0109473 | A1 * | 5/2005 | Bresson | 160/191 |
| 2006/0137138 | A1 * | 6/2006 | Mullet et al. | 16/197 |
| 2007/0187042 | A1 * | 8/2007 | Kallstrom | 160/7 |
| 2009/0313898 | A1 * | 12/2009 | Manaras et al. | 49/31 |
| 2010/0096092 | A1 * | 4/2010 | Liu et al. | 160/310 |
| 2010/0105507 | A1 * | 4/2010 | Gunton | 474/133 |
| 2011/0146920 | A1 * | 6/2011 | Mazej et al. | 160/311 |
| 2012/0145335 | A1 * | 6/2012 | Panseri et al. | 160/2 |
| 2013/0112357 | A1 * | 5/2013 | Gontarski et al. | 160/291 |
| 2013/0152478 | A1 * | 6/2013 | Lhotak et al. | 49/358 |
| 2014/0060754 | A1 * | 3/2014 | Hsieh | 160/7 |

* cited by examiner

ANTI-DROP TRANSMISSION DEVICE FOR A SERVICE DOOR WITH A FLEXIBLE CURTAIN

The present invention relates to an anti-drop transmission device for a roll-up or folding service door having a flexible curtain which moves from a closed position to an open position, and vice versa.

Anti-drop devices are known which concern more particularly doors with a metal curtain. It has been noted that doors with a metal curtain have an operating speed of the order of 0.2 meters per second, which equates to a rotational speed of the drive shaft of 16 revolutions per minute.

Anti-drop devices for service doors are known which enable the axle for rolling or folding up the flexible curtain to be secured following the breaking of the drive elements.

European patent EP 1 739 274, filed by the Applicant, discloses an anti-drop protection device comprising a structure mounted on the drive shaft and enabling a spring to be compressed when the flexible roll-up or folding apron of a vertical-lift service door descends.

It is known that all commercially available quick-acting doors are driven by a solution of the geared motor type with a two-speed motor. This is for several reasons:

- The most compact motors are the ones which run fastest, which means that 3000/155 rpm motors need to be used and that high-reduction (approximately 1/20) reducing gears need to be fitted. The chain or belt equivalent requires a double reduction but this is not appropriate for a compact design of the product;
- The reducing gears also entail a certain number of problems: possible oil leakage, fastening means need to be standard for all brands, expensive to buy, etc. Some of them incorporate anti-drop mechanisms but these products are patented and their complexity and cost are thus higher.
- The number of elements which make up the whole kinematic chain as its effectiveness is dependent on all the possible failures of the other elements situated between it and the rotating shaft. Some of these elements are overdimensioned because they cannot be automatically checked.
- Most doors on the market are equipped with a stop device set mechanically by the fitter (working at a height).

The object of the anti-drop transmission device according to the present invention is to overcome all the abovementioned problems by superposing two speed-reduction modes between the electric motor or geared motor and the drive shaft, namely:

- For the first reduction mode via an electric or electronic variable-speed drive controlling the electric motor or geared motor
- And for the second reduction mode via the mechanical reduction obtained by the difference in diameter or not of the transmission device arranged between the motor or the geared motor and the drive shaft.

The anti-drop transmission device for a service door with a flexible curtain which is folded or rolled around a drive shaft when it moves between an open position and a closed position, and vice versa, according to the present invention has, firstly, an independent electric motor or geared motor fixed with an axis of rotation which is offset and parallel with respect to that of the drive shaft and, secondly, an anti-drop protection device allowing the motor or the geared motor to be connected to the drive shaft and the accidental dropping-down of the flexible apron to be blocked.

The anti-drop transmission device according to the present invention comprises transmission means consisting of pulleys of diameters which may or may not be different, are connected together by a belt and enable the drive shaft to be driven in rotation by the electric motor or geared motor, electromechanical means for checking the tension of the belt, and brake means enabling the rotation of the drive shaft to be stopped.

The anti-drop transmission device according to the present invention comprises an electric motor or geared motor which is fixed in proximity to the drive shaft in such a way that its output axle is arranged in a direction which is parallel to the output axle of said drive shaft.

The anti-drop transmission device according to the present invention comprises an output axle of the electric motor or geared motor which is integrally connected to a drive pulley which interacts with a belt which enables said first pulley to be connected to another pulley which may or may not have a larger diameter and is integrally connected to the output axle of the drive shaft.

The anti-drop transmission device according to the present invention comprises, in the extension of the output axle of the electric motor or geared motor, a sensor connected to an electric variable-speed drive so as to manage the speed with which the flexible curtain is moving and when it is stopped by continuously measuring the mechanical position of said flexible curtain.

The anti-drop transmission device according to the present invention comprises a band brake which comes into contact with the pulley mounted on the output axle of the drive shaft.

The anti-drop transmission device according to the present invention comprises a tension sensor enabling the tension of the belt connecting the pulleys to be checked electromechanically.

The anti-drop transmission device according to the present invention comprises a tension sensor which consists of a tensioning roller guided in rotation in a support, whilst pressure is applied to the spindle of the roller either directly or indirectly by resilient means ensuring that the flexible curtain does not drop down by pilot-controlling and locking the band brake in the event of the belt breaking or the tension of said belt being set wrongly.

The anti-drop transmission device according to the present invention comprises resilient means of the tension sensor which consist of a spring which comes into direct contact with the spindle of the roller.

The anti-drop transmission device according to the present invention comprises resilient means of the tension sensor which consist of a spring which comes into contact with a lever arm, said lever arm pivoting about an axle and bearing, at the opposite end from said axle, the roller which is free to rotate about its spindle.

The anti-drop transmission device according to the present invention comprises resilient means of the tension sensor which consist of a resiliently deformable support bearing at one of its ends the roller which is free to rotate about its spindle.

The anti-drop transmission device according to the present invention comprises an electronic device enabling the wear of the transmission belt to be continuously checked when the latter has one or more continuous metal armatures in its thickness or surface.

The anti-drop transmission device according to the present invention comprises a continuous metal armature which consists of continuous metal wires or metal threads or a sheet of metal wires.

The present invention also relates to a method for securely driving a drive shaft of a service door with a flexible curtain consisting in reducing the speed between the electric motor or geared motor and the drive shaft in two steps, namely a first step by means of an electric or electronic variable-speed drive which controls the electric motor or geared motor, and then in a second step by means of the mechanical reduction obtained by the difference in diameter between the pulleys connected by the belt of the anti-drop protection device.

The present invention also relates to a method for continuously detecting the breaking of a drive belt with a metal armature of an anti-drop protection device for a service door comprising an electronic device which consists in continuously measuring the impedance of the metal armature of the belt, in locking the drive shaft after the metal armature has broken, indicating a change in impedance or reluctance of said metal armature which forms the signal that the belt has broken.

The invention, its features and the advantages that it can provide can be better understood from the following description, made with reference to the attached drawings which are given by way of non-limiting examples.

Figure 1:
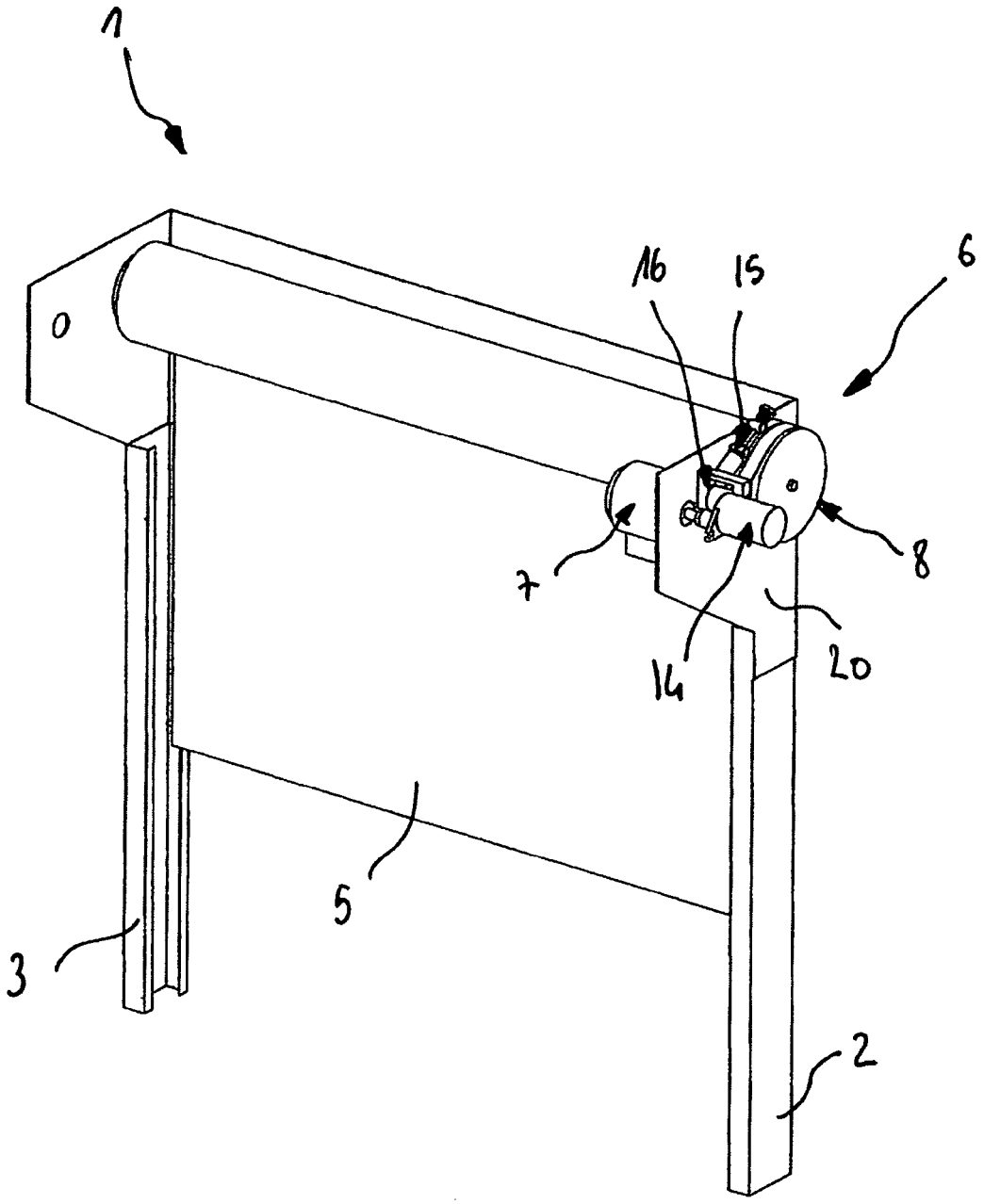
FIG. 1 is a perspective view illustrating an example of a roll-up service door comprising an anti-drop transmission device according to the present invention.

FIG. 1 shows a service door 1 comprising two side jambs 2 and 3 which are generally fixed against the vertical walls of an opening which needs to be blocked.

The opposite vertical jambs 2 and 3 are joined together, in the upper part of the service door 1, by a drive shaft or driving drum 4 enabling a flexible apron 5 to be moved between an open position and a closed position.

It is noted that the flexible apron generally comprises sleeves, into which horizontal stiffening cross-pieces are inserted, the ends of which interact with a guide device, not shown, forming a slideway, provided on each jamb 2 and 3.

Each guide device can be made from two opposing slides, not shown, which consist, for example, of either two tensioned and flexible straps or two semi-rigid or rigid blades arranged facing each other so as to form, on each jamb 2 and 3 and over their entire height, a slideway for guiding the flexible curtain or apron 5.

The service door 1 comprises an anti-drop transmission device 6 comprising, firstly, an independent electric motor or geared motor 7 fixed in the upper and inner part of one of the jambs 2, 3 with an axis that is offset and parallel with respect to that of the axis of rotation of the drive shaft 4 and, secondly, an anti-drop protection device 8 fixed in the upper and outer part of one of the jambs 2, 3 enabling the electric motor or geared motor 7 to be connected to the drive shaft 4, and the accidental dropping-down of the roll-up or folding flexible apron 5 of the vertical-lift service door 1 to be blocked.

Figure 2:
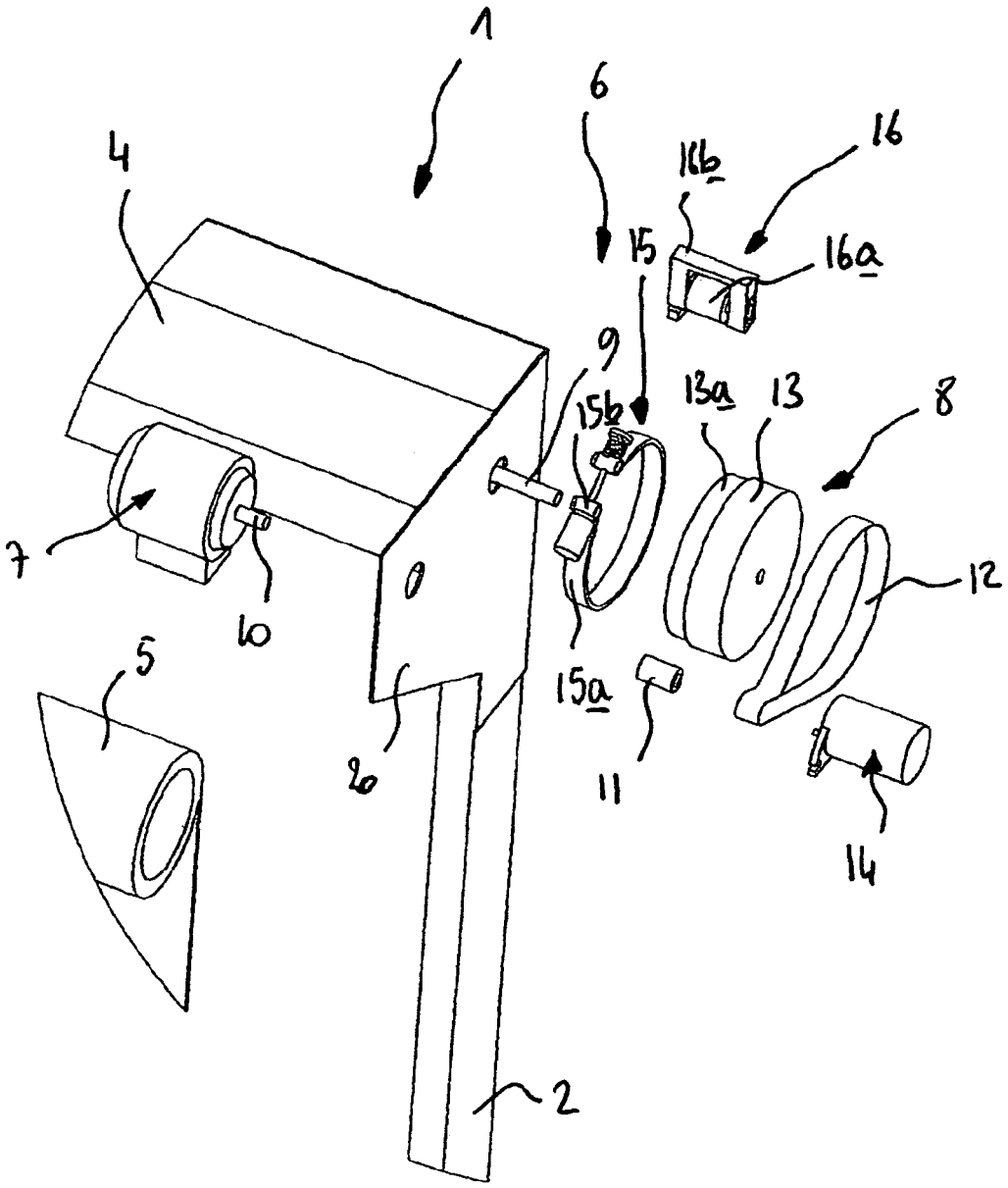
FIGS. 2 to 4 are views showing the different components which make up the anti-drop transmission device according to the present invention.
Figure 3:
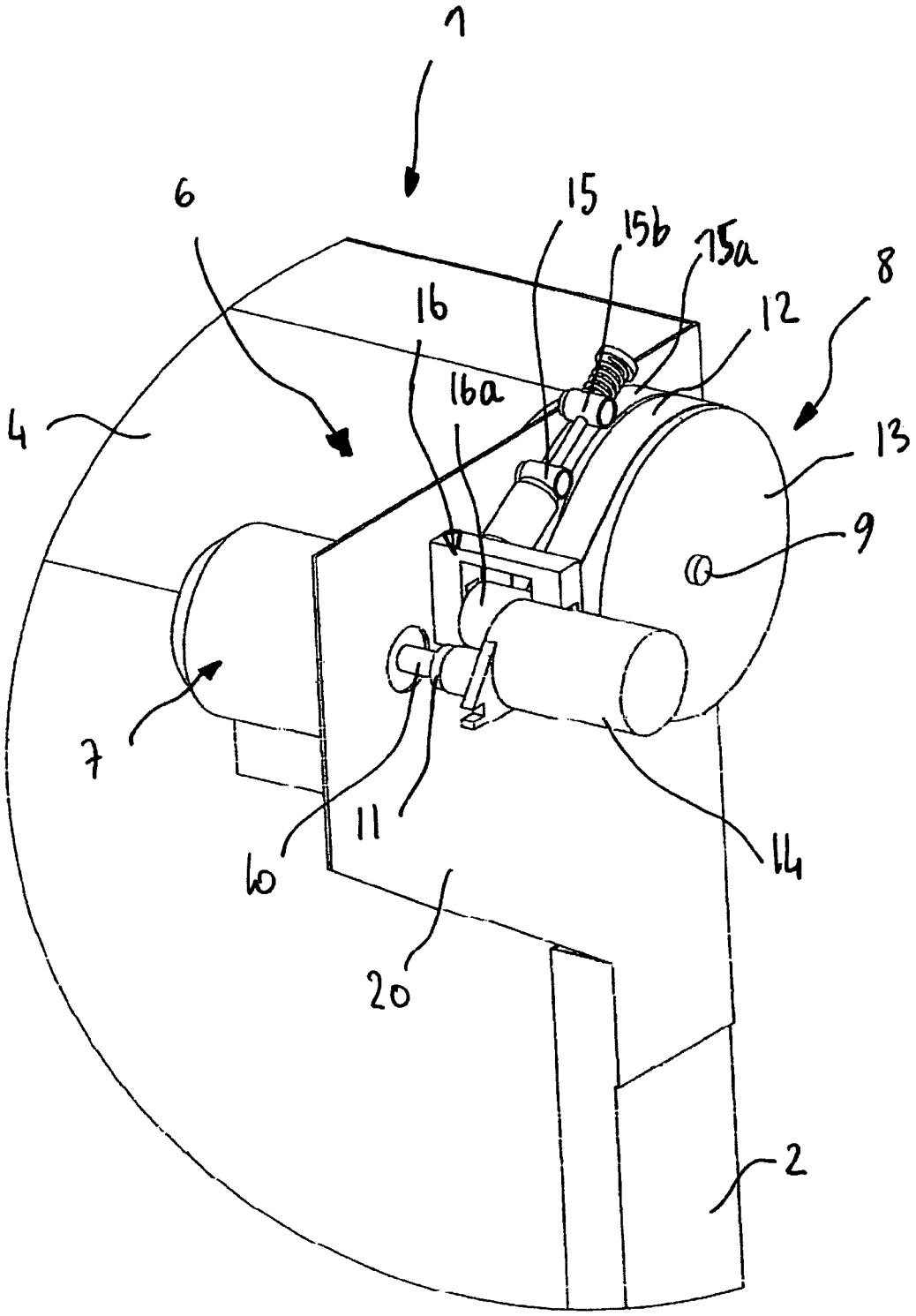
Figure 4:
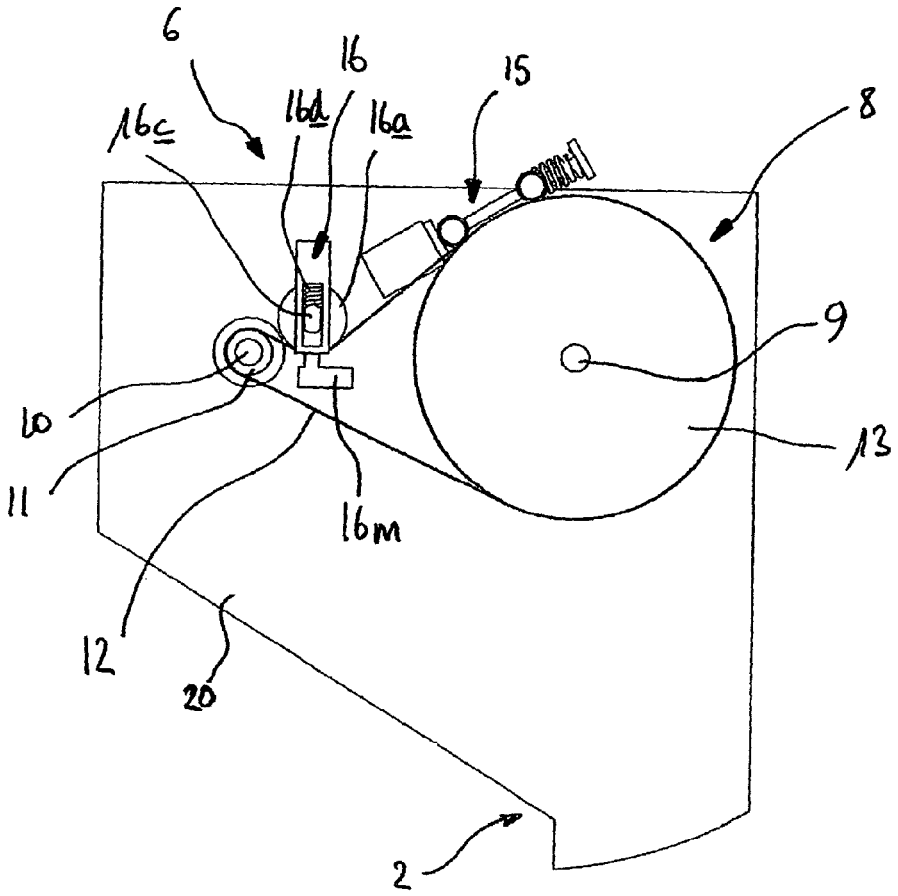

FIGS. 2 to 4 show the anti-drop transmission device 6 according to the present invention, the anti-drop protection device 8 of which is mounted directly on the output axle 9 of the drive shaft 4 of the service door 1.

The anti-drop transmission device 6 comprises a motor or a geared motor 7 which is arranged between the jambs 2, 3 of the service door 1 and more particularly on the inner face of a flange 20 extending, for example, the upper part of the jamb 2.

The motor or geared motor 7 is fixed on the flange 20 in proximity to the drive shaft 4 in such a way that its output axle 10 is arranged in a direction which is parallel to that of the output axle 9 of said drive shaft.

The flange 20 extending the upper part of the jamb 2 is pierced with a hole for the passage of the output axle 10 so that the latter is situated in a direction which is offset and parallel with respect to that of the output axle 9 of the drive shaft 4.

The output axle 10 of the electric motor or geared motor 7 is integrally connected, on the outer face of the flange 20 of the jamb 2, with a drive pulley 11 which interacts with a belt 12 enabling said first pulley 11 to be connected to another pulley 13 with a larger diameter, integrally connected to the output axle 9 of the drive shaft 4. When an electric geared motor is used, the pulleys 11 and 13 can have the same diameter as the speed reduction is obtained by said geared motor.

The motor or geared motor 7 is connected to an electric or electronic variable-speed drive enabling the rotational speed of said motor or geared motor to be adjusted.

The anti-drop transmission device 6 thus permits speed reductions between the motor or geared motor 7 and the drive shaft 4 in two steps, namely a first step by means of the electric variable-speed drive controlling the motor or the geared motor 7, and then in a second step by means of the mechanical reduction obtained by the difference in diameter between the pulleys 11 and 13 connected by the belt 12.

The mechanical reduction can be achieved by any other flexible means, for example of the pinion and chain type, whilst keeping the output axles of the motor or geared motor 7 and the drive shaft 4 parallel.

The anti-drop protection device 8 of the anti-drop transmission device 6 comprises, in the extension of the output axle 10 of the motor or geared motor 7, a sensor 14 so as to manage the speed with which the flexible curtain 5 is moving and when it is stopped by continuously measuring the mechanical position of said flexible curtain.

The anti-drop protection device 8 of the anti-drop transmission device 6 comprises a band brake 15 which comes into contact with the pulley 13 of the drive shaft 4 and more particularly a track 13*a* of said pulley 13 which is provided solely for this purpose.

The band brake 15 ensures either the so-called parking braking when the flexible curtain 5 is stopped, or the exceptional dynamic emergency braking in the event of the kinematic chain formed by the pulleys 11, 13 and the belt 12 or any other drive means breaking.

The band brake 15 is of the electric zero-current type with an electric lock 15*c*. The band brake 15 consists of an open band 15*a* which runs around the track 13*a* of the pulley 13. The ends of the band 15*a* are connected by a resiliently loaded closure device 15*b*.

The anti-drop protection device 8 consists of a tension sensor 16 which allows the tension of the belt 12 connecting the pulleys 11 and 13 to be checked electromechanically. The tension sensor 16 performs an anti-drop function by pilot-controlling and locking the band brake 15 in the event of the belt 12 breaking or the tension being wrongly set.

Figure 5:
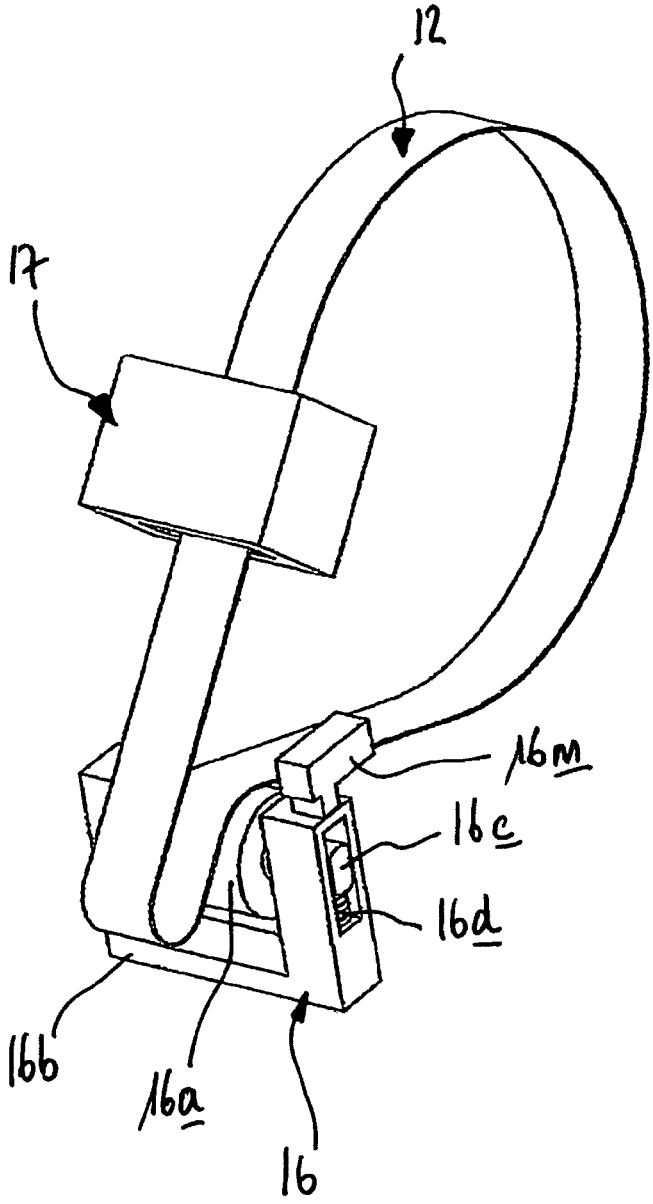
FIG. 5 is a perspective view showing the anti-drop transmission device provided with an electronic device for checking the wear of the belt and with an electromechanical belt-tensioning device.
Figure 6:
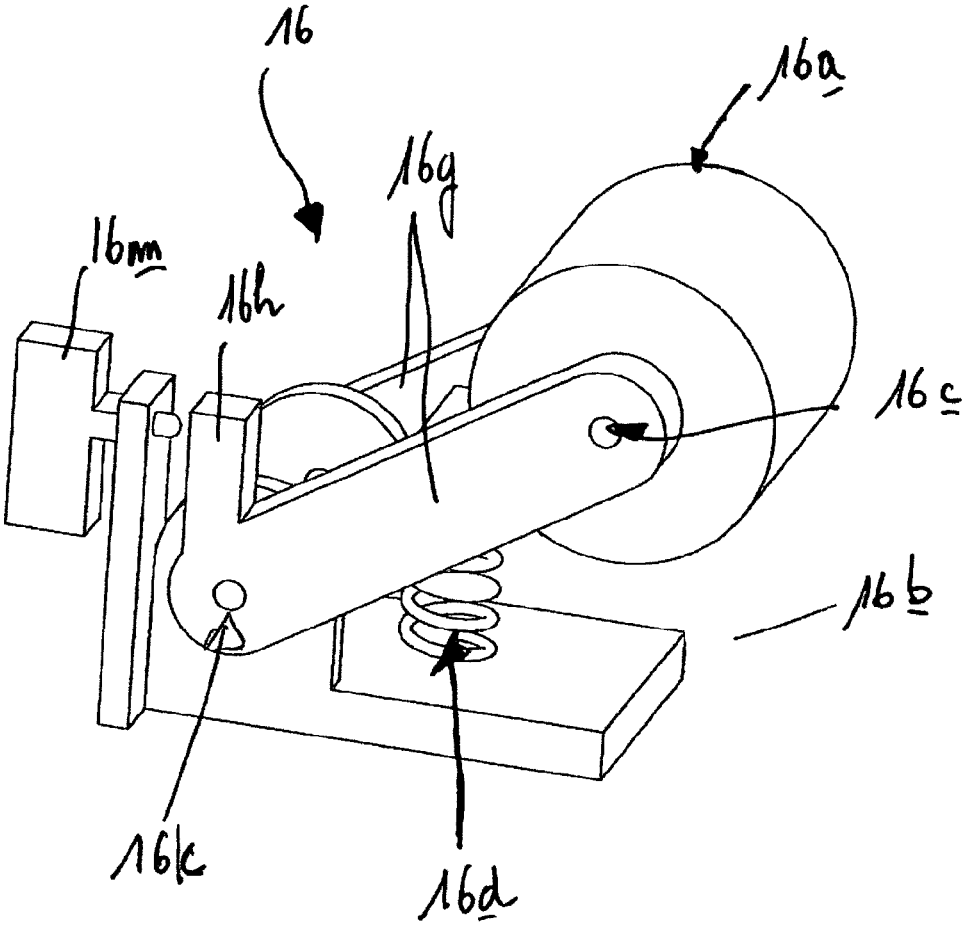
FIG. 6 is a perspective view illustrating a first alternative embodiment of the electromechanical belt-tensioning device of the anti-drop transmission device according to the present invention.
Figure 7:
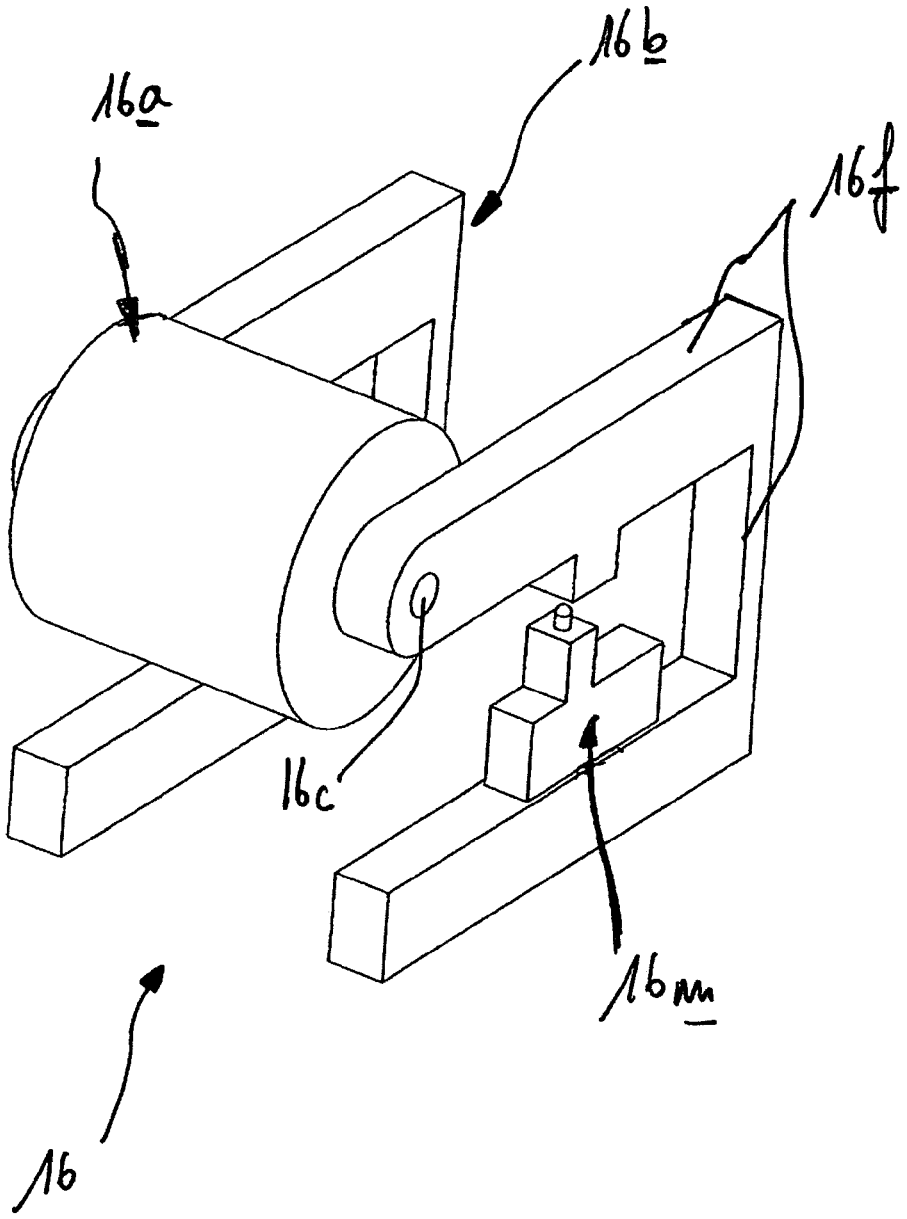
FIG. 7 is a perspective view showing a second alternative embodiment of the electromechanical belt-tensioning device of the anti-drop transmission device according to the present invention.

The tension sensor 16 consists of a tensioning roller 16*a* guided in rotation in a support 16*b* fixed to the outer face of the flange 20 of the jamb 2. Pressure is applied to the spindle 16*c* of the roller 16*a* either directly or indirectly via resilient means which consist, for example, of:

a spring 16*d* which comes into direct contact with the spindle 16*c* of the roller 16*a* (FIGS. 4, 5);

a spring 16*d* or a counterweight interacting with a lever arm 16*g* pivoting about an axle 16*k* and bearing, at the opposite end from said axle 16*k*, the roller 16*a* which is free to rotate about its spindle 16*c* (FIG. 6);

a resiliently deformable support 16*f* bearing at one of its ends the roller 16*a* which is free to rotate about its spindle 16*c* (FIG. 7).

Thus, if the belt 12 breaks, it causes the displacement of the spindle 16*c* of the roller 16*a* either under the pressure of the spring 16*d* or as a result of the deformation of the resilient frame 16*f*. The displacement of the spindle 16*c* or of the resilient frame 16*f* is detected by an electromechanical or electronic device 16*m* signaling that the belt 12 has broken so as to pilot-control the band brake 15 to lock the drive shaft 4 of the service door 1 in rotation.

FIG. 5 shows an electronic device 17 enabling the wear of the transmission belt 12 to be continuously checked when the latter has one or more continuous metal armatures, consisting for example of continuous metal wires or metal threads or sheets of metal wires, in its thickness or surface.

By means of a detector, the electronic device 17 makes it possible to permanently check the continuity of the continuous metal wires or threads or armatures which are contained in the belt 12.

In the event of this armature or these armatures becoming worn or breaking, the electronic device 17 pilot-controls the band brake 15, via the electrical cabinet, so as to lock the drive shaft 4 of the service door 1 in rotation and hence stop the flexible curtain 5 from descending.

The electronic device 17 can be based, for example, on measurement of the impedance of the metal armature functioning as a coil. In the event of the metal armature breaking, the magnetic circuit is opened, indicating a change in the impedance or reluctance of the metal armature which forms the signal that the belt 12 has broken.

It is noted that the electrical cabinet of the service door 1 controls a unit for storing electrical energy (a battery) which enables this energy to be redistributed in the event of a power cut in order to unlock the flexible curtain 5 of said door.

It should moreover be understood that the above description has been given only by way of example and that it in no way limits the scope of the invention, beyond which one would not go if the described details of implementation were replaced by any equivalent.

The invention claimed is:

1. An anti-drop transmission device for a service door (1) with a flexible curtain (5), said anti-drop transmission device (6) comprising:

a drive shaft (4) that holds the flexible curtain (5) of the service door (1), wherein, the drive shaft (4) is located on an upper part of a first jamb (2) of opposite vertical first and second jambs (2, 3), the drive shaft (4) includes an output shaft (9) that extends through the first jamb from an inner side to an outer side of the first jamb (2), and when moving between an open position and a closed position, the flexible curtain is rolled around the drive shaft;

a motor (7) fixed on the first jamb (2), the motor having an output axle (10) that extends through the first jamb from the inner side to the outer side of the first jamb (2), the output axle (10) having an axis of rotation offset and parallel with respect to an axis of rotation of the drive shaft (4); and an anti-drop protection device (8) connecting the motor (7) to the drive shaft (4), the anti-drop protection device (8) that provides speed reductions between the motor and the drive shaft, the anti-drop protection device (8) comprising i) a first pulley (11) integrally connected to the output axle (10) of the motor (7), ii) a second pulley (13) integrally connected to the output shaft (9) of the drive shaft (4), iii) a belt (12) connecting said first and second pulleys (13, 11), the first and second pulleys together with the belt (12) forming a kinematic chain, and iv) a variable-speed drive which controls a speed of the motor (7), v) a brake unit (15) that provides parking braking when the drive shaft is stopped, and dynamic emergency braking in an event of the kinematic chain formed by the first and second pulleys (11, 13) and the belt (12) breaking, wherein activation of the brake unit (15) blocks the rotation of the drive shaft (4), and vi) a tension sensor (16) checking a tension of the belt (12) connecting the first and second pulleys (11, 13) to thereby detect the event of the kinematic chain formed by the first and second pulleys (11, 13) and the belt (12) breaking, the tension sensor (16) providing an anti-drop function activating the brake unit (15) to prevent rotation of the drive shaft (4) upon detecting the event of the kinematic chain formed by the first and second pulleys (11, 13) and the belt (12) breaking, wherein the anti-drop protection device (8) controls the motor (7) to drive the drive shaft (4), via the belt (12), between the open and closed positions and blocks the accidental dropping-down of the flexible apron (5) by preventing rotation of the drive shaft (4).

2. The anti-drop transmission device as claimed in claim 1, wherein the tension sensor (16) electromechanically checks the tension of the belt (12) connecting the pulleys (11 and 13).

3. The anti-drop transmission device as claimed in claim 1, wherein the brake unit (15) comprises a band (15*a*) which comes into contact with the second pulley (13) mounted on the output axle (9) of the drive shaft (4).

4. The anti-drop transmission device as claimed in claim 3, wherein the band (15*a*) is an open band (15*a*) which runs around a track (13*a*) of the second pulley (13) with ends of the band (15*a*) connected by a resiliently loaded closure device (15*b*).

5. The anti-drop transmission device as claimed in claim 1, wherein, said motor is an electric motor, said motor is fixed in the upper part and the inner side of said first jamb (2), the anti-drop protection device (8) is fixed in the upper part and the outer side of said first jamb (2), the anti-drop transmission device (6) is mounted directly on the output axle (9) of the drive shaft (4), the anti-drop protection device (8) provides a mechanical reduction in speed between the motor and the drive shaft by a diameter of the first pulley (11) being different from a diameter of the second pulley (13), and the tension sensor (16) is an electromechanical device.

6. The anti-drop transmission device as claimed in claim 5, wherein the band (15*a*) is an open band (15*a*) which runs around a track (13*a*) of the second pulley (13) with ends of the band (15*a*) connected by a resiliently loaded closure device (15*b*).

7. The anti-drop transmission device as claimed in claim 1, wherein, said motor is a geared motor, said motor is fixed in the upper part and the inner side of said first jamb (2), the anti-drop protection device (8) is fixed in the upper part and the outer side of said first jamb (2), the anti-drop transmission device (6) is mounted directly on the output axle (9) of the drive shaft (4), the anti-drop protection device (8) provides a mechanical reduction in speed between the motor and the drive shaft by a diameter of the first pulley (11) being different from a diameter of the second pulley (13), and the tension sensor (16) is an electromechanical device.

8. The anti-drop transmission device as claimed in claim 7, wherein the band (15*a*) is an open band (15*a*) which runs around a track (13*a*) of the second pulley (13) with ends of the band (15*a*) connected by a resiliently loaded closure device (15*b*).

9. The anti-drop transmission device as claimed in claim 1, wherein the motor (7) is fixed in proximity to the drive shaft (4) in such a way that the output axle (10) is arranged in a direction which is parallel to the output axle (9) of said drive shaft.

10. The anti-drop transmission device as claimed in claim 9, wherein the output axle (10) of the motor (7) is integrally connected to the first pulley (11) which interacts with the belt (12) which enables said first pulley (11) to be connected to the second pulley (13) which is integrally connected to the output axle (9) of the drive shaft (4).

11. The anti-drop transmission device as claimed in claim 9, wherein, the belt (12) includes one or more continuous metal armatures in a thickness thereof or on a surface thereof, and the anti-drop protection device (8) further comprises an electronic device (17) that continuously check a continuity of the one or more continuous metal armatures.

12. The anti-drop transmission device as claimed in claim 11, wherein the one or more continuous metal armatures comprise one of the group consisting of continuous metal wires, continuous metal threads, and a sheet of metal wires.

13. The anti-drop transmission device as claimed in claim 11, wherein the electronic device (17) of the anti-drop protection device (8) comprises means for continuously measuring an impedance of the metal armature of the belt (12) and indicating a change in the impedance or reluctance of said metal armature which forms a signal that the metal armature of the belt (12) has broken, the signal activating the brake unit (15) to prevent rotation of the drive shaft (4).

14. The anti-drop transmission device as claimed in claim 1, wherein the anti-drop protection device (8) comprises, in an extension of the output axle (10) of the motor (7), a sensor (14) connected to the variable-speed drive so as to manage the speed with which the flexible curtain (5) is moving and stopped by continuously measuring a mechanical position of said flexible curtain.

15. The anti-drop transmission device as claimed in claim 14, wherein the tension sensor (16) comprises a tensioning roller (16*a*) with a spindle (16*c*), the tensioning roller (16*a*) guided in rotation in a support (16*b*), with pressure applied to the spindle (16*c*) of the roller (16*a*) by resilient means for ensuring that the flexible curtain (5) does not drop down by pilot-controlling and locking the band brake (15) in the event of the belt (12) breaking or the tension of said belt being improper.

16. The anti-drop transmission device as claimed in claim 15, wherein the resilient means of the tension sensor (16) comprises a spring (16*d*) which comes into direct contact with the spindle (16*c*) of the roller (16*a*).

17. The anti-drop transmission device as claimed in claim 15, wherein the resilient means of the tension sensor (16) comprises a spring (16*d*) which comes into contact with a lever arm (16*g*), said lever arm (16*g*) pivoting about an axle (16*k*) and bearing, at an opposite end from said axle (16*k*), the roller (16*a*) which is free to rotate about spindle (16*c*).

18. The anti-drop transmission device as claimed in claim 15, wherein the resilient means of the tension sensor (16) comprises a resiliently deformable support (16*f*) bearing at one of end the roller (16*a*) which is free to rotate about spindle (16*c*).

19. An anti-drop transmission device for a service door (1) with a flexible curtain (5), said anti-drop transmission device (6) comprising:

a drive shaft (4) located on a first jamb (2) of opposite vertical first and second jambs (2, 3), the drive shaft (4) including an output shaft (9) that extends through the first jamb from an inner side to an outer side of the first jamb (2), and when moving between an open position and a closed position, the flexible curtain is rolled around the drive shaft;

a motor (7) fixed on the first jamb (2), the motor having an output axle (10), the output axle (10) having an axis of rotation offset and parallel with respect to an axis of rotation of the drive shaft (4); and an anti-drop protection device (8) that provides speed reductions between the motor and the drive shaft, the anti-drop protection device (8) comprising i) a first pulley (11) integrally connected to the output axle (10) of the motor (7), ii) a second pulley (13) integrally connected to the output shaft (9) of the drive shaft (4), iii) a belt (12) connecting said first and second pulleys (13, 11), the first and second pulleys together with the belt (12) forming a kinematic chain, and iv) a variable-speed drive which controls a speed of the motor (7), v) a brake unit (15) that provides dynamic emergency braking in an event the kinematic chain formed by the first and second pulleys (11, 13) and the belt (12) breaking, wherein activation of the brake unit (15) blocks the rotation of the drive shaft (4), and vi) a tension sensor (16) checking a tension of the belt (12) connecting the first and second pulleys (11, 13) to thereby detect the event the kinematic chain formed by the first and second pulleys (11, 13) and the belt (12) breaking, the tension sensor (16) providing an anti-drop function activating the brake unit (15) to prevent rotation of the drive shaft (4) upon detecting the event of the kinematic chain formed by the first and second pulleys (11, 13) and the belt (12) breaking, wherein the anti-drop protection device (8) both i) controls the motor (7) to drive the drive shaft (4), via the belt (12), between the open and closed positions and ii) blocks the accidental dropping-down of the flexible apron (5) by preventing rotation of the drive shaft (4) upon detecting of checking the tension of the belt (12) indicating the event of the kinematic chain formed by the first and second pulleys (11, 13) and the belt (12) breaking.

20. The anti-drop transmission device as claimed in claim 19, wherein, said motor is fixed in the upper part and the inner side of said first jamb (2), the anti-drop protection device (8) is fixed in the upper part and the outer side of said first jamb (2), the anti-drop transmission device (6) is mounted directly on the output axle (9) of the drive shaft (4), the anti-drop protection device (8) provides a mechanical reduction in speed between the motor and the drive shaft by a diameter of the first pulley (11) being different from a diameter of the second pulley (13), and the tension sensor (16) is an electromechanical device, and the band (15*a*) is an open band (15*a*) which runs around a track (13*a*) of the second pulley (13) with ends of the band (15*a*) connected by a resiliently loaded closure device (15*b*).

* * * * *